United States Patent [19]

Luchi

[11] 4,253,498

[45] Mar. 3, 1981

[54] TRAVELLING WAVE SHEDDING LOOMS RELATIVE TO THE SHUTTLE LOADING SYSTEM

[76] Inventor: Vinicio Luchi, Via W. Pareto 43, Prato, Florence, Italy

[21] Appl. No.: 22,105

[22] Filed: Mar. 20, 1979

[51] Int. Cl.[3] ..... D03J 1/12; D03D 47/26

[52] U.S. Cl. ..... 139/224 R; 139/436

[58] Field of Search ..... 139/436, 224 R, 224 A, 139/302

[56] References Cited

U.S. PATENT DOCUMENTS

| | | | |
|---|---|---|---|
| 3,732,896 | 5/1973 | Jekl et al. | 139/224 R |
| 3,943,976 | 3/1976 | Vilaseca | 139/436 |
| 4,071,052 | 1/1978 | Vasek et al. | 139/302 |

FOREIGN PATENT DOCUMENTS

| | | | |
|---|---|---|---|
| 1339777 | 12/1973 | United Kingdom | 139/224 R |
| 218032 | 12/1968 | U.S.S.R. | 139/224 R |

*Primary Examiner*—Henry Jaudon

*Attorney, Agent, or Firm*—Hopgood, Calimafde, Kalil, Blaustein & Lieberman

[57] ABSTRACT

A travelling wave shedding loom has a plurality of devices for winding and loading shuttle bobbins. One such device is provided for each shuttle, and the respective devices move with their associated shuttles around a continuous path within the loom.

8 Claims, 21 Drawing Figures

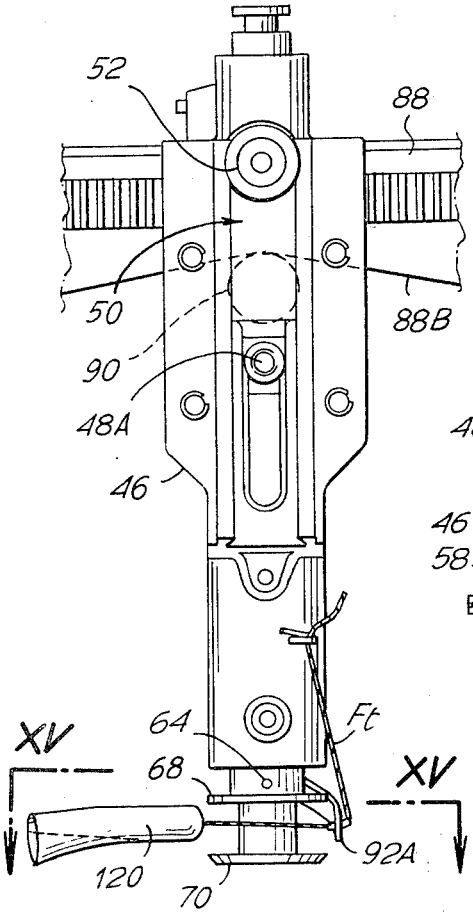
Fig.9
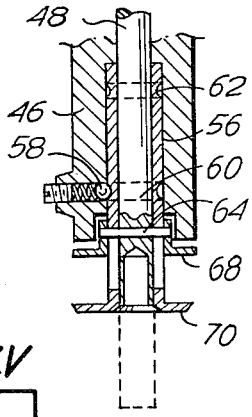
Fig.10
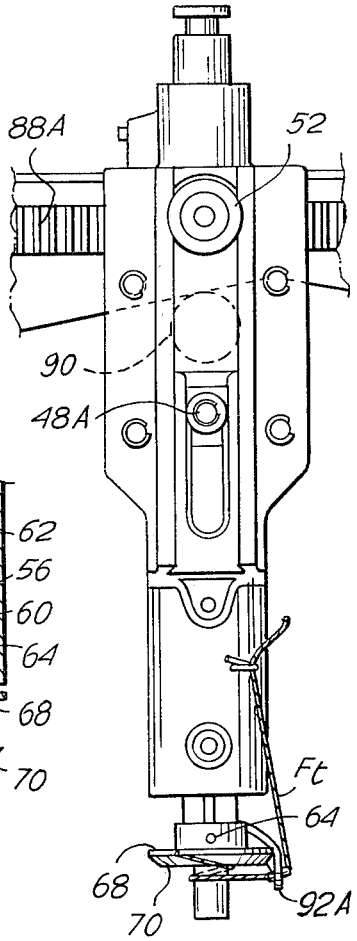
Fig.11
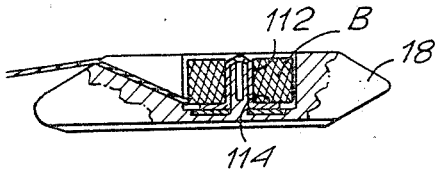
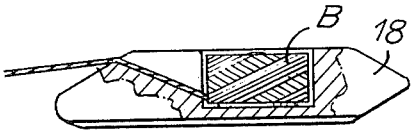

TRAVELLING WAVE SHEDDING LOOMS RELATIVE TO THE SHUTTLE LOADING SYSTEM

BACKGROUND OF THE INVENTION

1. Field of the Invention

This invention relates to so-called travelling wave shedding looms, and in particular to a device for winding and loading shuttle bobbins in such a loom.

2. Description of the Prior Art

Devices have been proposed for winding and loading the shuttle bobbins in a travelling wave shedding loom but these devices suffer from the disadvantage that a high speed of bobbin winding is required because these devices are located outside the working front of the loom, and are also limited in number.

SUMMARY OF THE INVENTION

According to the present invention, there is provided in a travelling wave shedding loom, a plurality of shuttles, and a device for winding and loading shuttle bobbins of the loom, said device comprising a movable support member associated with each shuttle and movable with the shuttle, a winding-loading mechanism and means for mounting a storage spool carried by each support member, means for withdrawing metered quantities of weft yarn from each storage spool and for forming one respective bobbin per shuttle on the respective winding-loading mechanism during delivery of successive wefts from a preceding bobbin, and means for effecting transfer of the bobbin from the mechanism to the respective shuttle.

In a preferred embodiment, the movable support members are supported by chain carriages having selection means and cams for controlling the heals and which advance with the shuttles.

Each winding-loading mechanism preferably comprises a winding shaft rotatable via a clutch for winding yarn to form a bobbin, and axially slidable for transferring the bobbin into a seat provided therefor in the respective shuttle, and means for discharging the bobbin. Yarn cutting means are provided to act on the yarns of the successive bobbins formed on the mechanisms while these are moving.

Insertable cams can be provided for controlling the clutches in order to wind precise quantities of yarn on to the bobbins to be transferred. The cam profile for the clutches is also adjustable in order to adjust the quantity of yarn contained on the bobbins, and thus the number of wefts which can be delivered.

The winding and transfer shaft can comprise a disc end forming a discharge member and cooperating with a further disc movable into two positions, and constituting gripping means for gripping the end of the yarn, for cutting it, and for releasing it. The seat for the bobbin in each shuttle preferably comprises an idle disc element with a tubular guide and centering stem for the bobbin.

Preferably a cutting mechanism provided at the outlet of the wefts can be temporarily delayed in its action, in order to obtain total unwinding of the weft residues on the nearly simultaneous emptying of all the bobbins of the shuttles in operation.

BRIEF DESCRIPTION OF THE DRAWINGS

An embodiment of the invention will now be described, by way of example only, with reference to the accompanying diagrammatic drawings, in which:

FIGS. 8, 9 10 and 11 shows further working stages of the mechanism during the loading cycle of a corresponding shuttle;

DESCRIPTION OF THE PREFERRED EMBODIMENT

Figure 2:
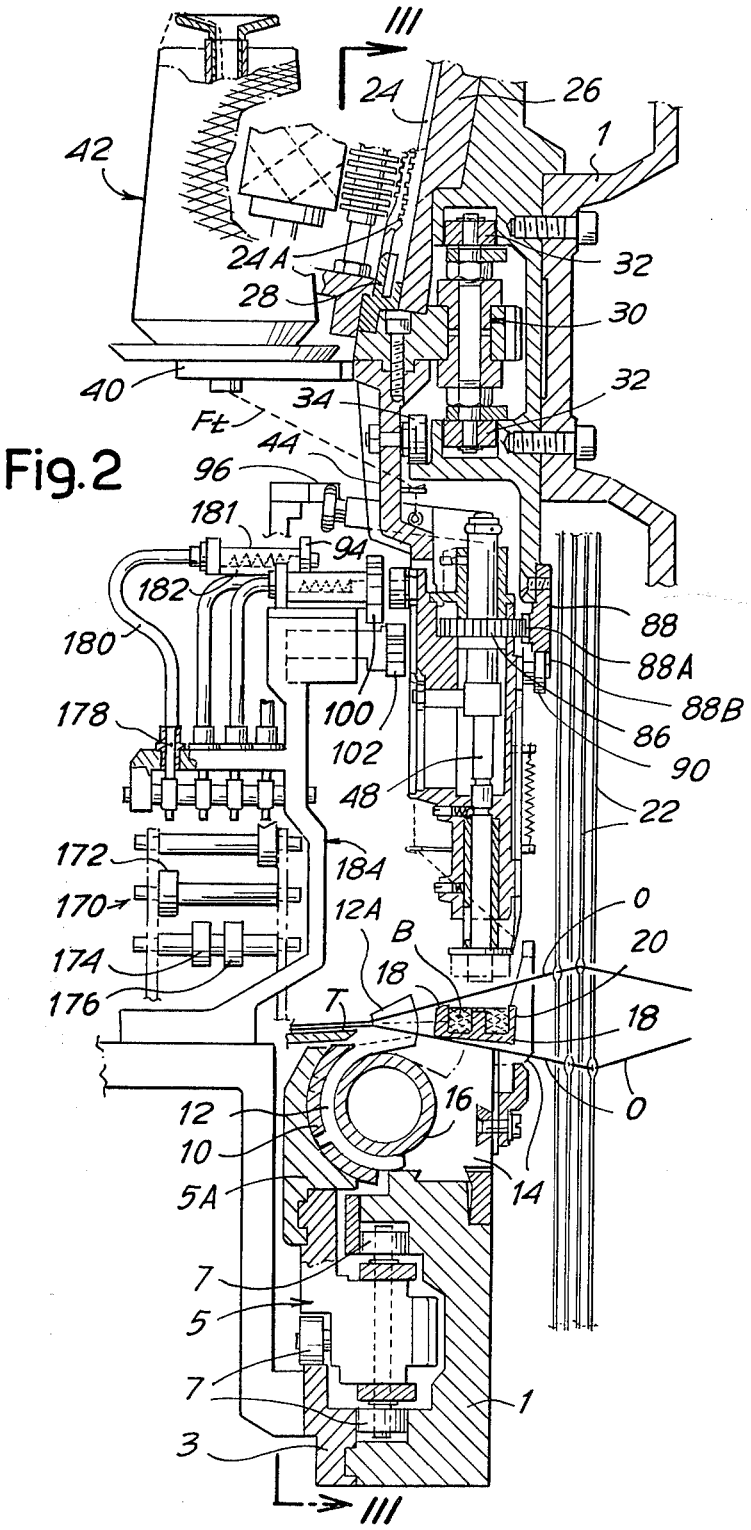
FIG. 2 is a local vertical section perpendicular to a working front of the loom.
Figure 2A:
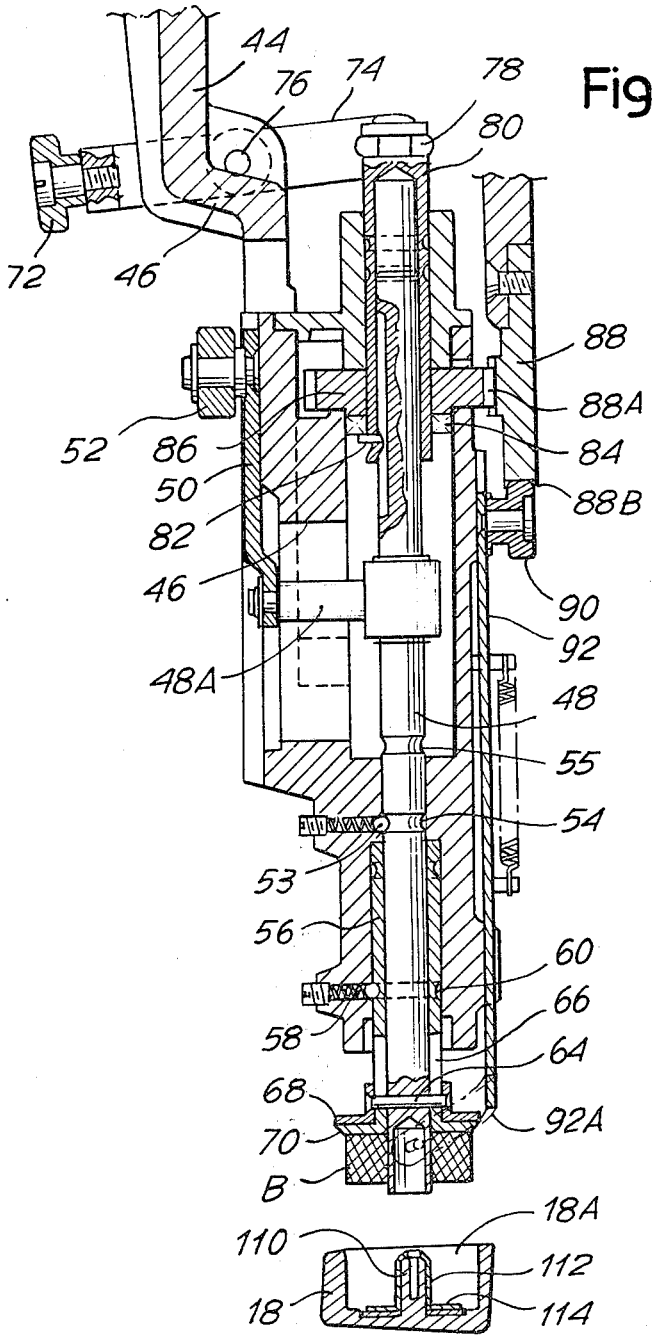
FIG. 2A shows an enlarged detail of FIG. 2.
Figure 3:
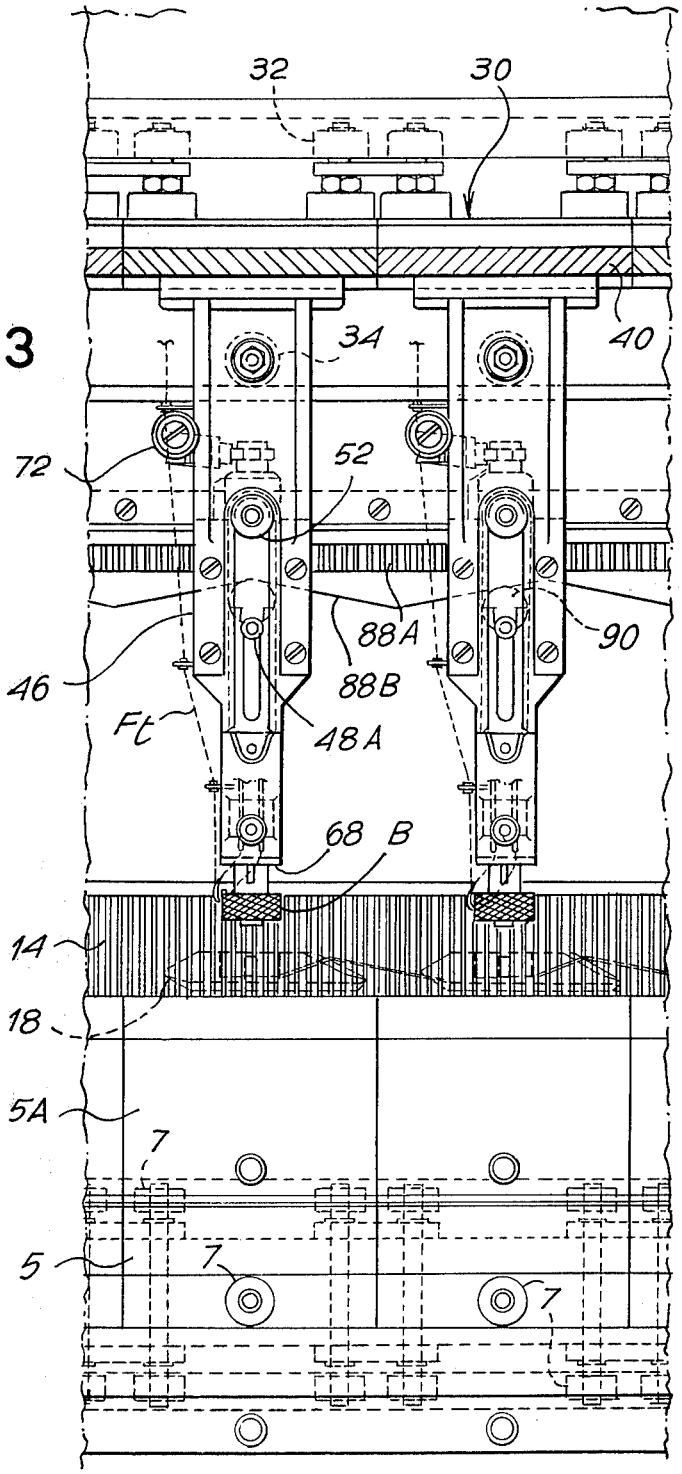
FIG. 3 is a partial front view on line III—III of FIG. 2.

The travelling wave shedding loom shown in the drawings is similar overall to that shown for example in my U.S. Patent Applications Ser. Nos. 794,231 and 794,232 filed Feb. 5, 1977 and my British Patent Applications 19712/77 and 19713/77, the disclosure of which is herein incorporated by reference The reference numeral 1 indicates a fixed structure which at its bottom, together with an inserted element 3, forms a track for carriages 5 which are connected together to form an endless chain and are provided with rollers 7 by which the carriages move along two opposed rectilinear working fronts or along one working front and an opposed front, the opposed fronts being connected by semi-circular connecting paths. The chain is driven by at least one of two sprocket wheels 8 located on the semi-circular connecting paths. Also located on the semi-circular connecting paths are wheels 9 having tongues 9B for moving the shuttles along the connecting path. At least one of the two wheels 9 is a driven wheel. Each carriage 5 comprises a part 5A provided with a concave cam 10 (see FIG. 2). These cams 10 serve to rock a plurality of arcuate laminar elements 12 along the rectilinear fronts, these elements being each provided with a control butt for this purpose. The elements 12 are mounted in arcuate grooves formed by laminar elements 14 fixed to the structure 1 and to a tubular member 16 which defines the base of the grooves. The purpose of the elements 12 is on the one hand to urge the deposited weft yarns against the fabric T being formed, that is to beat-up the weft yarns, and on the other hand to determine the "wave" advancement movement of shuttles 18 which slide in a track defined by a fixed rectilinear shoulder 20 in the form of a comb and a movable side defining successive travelling waves and formed by the ends 12A of the elements 12, which are displaced angularl in a cyclical manner by the cams 10. In this manner, as the ends 12A move towards the shoulder 20, a thrust is imparted to an inclined rear profile of the shuttles 18, causing them to advance through the warp shed defined by the warps O, the warps being reversed after the passage of each shuttle.

The warps are controlled by healds 22 selected cyclically with the aid of jacks 24, which are mounted on a bed 26 provided with grooves for them. The jacks are selected by butts 42A by the raising and lowering of cams 28, the selection taking place by means of selection drums 29 which advance, like the shuttles, past the bed 26. This arrangement is clearly illustrated in the aforesaid applications indicated heretofore. The selection drums are supported and moved by a series of carriages 30 similar to the carriages 5 and rolling by means of rollers 32 and 34 on guides formed by the structure 1. As in the case of the carriages 5, the carriages 30 are also connected together to form a chain which is driven by wheels 31 similar to and coaxial with the wheels 9, so that they slide along the rectilinear working front and the return front, or along the two working fronts, in a manner exactly synchronous with the advancement of the shuttles 20. With the selection imposed by the jacks 24, 24A, the healds 22 determine the crossing of the warps O progressively during the interval between the passage of two successive shuttles, in accordance with programmes set by the drums 29.

In a travelling wave shedding loom of this type, the individual shuttles 18 must be loaded with the yarn which is to be deposited in the warp shed. This loading can take place on the semi-circular paths along which the tongues 9B are operative to push the shuttles. The tongues 9B are provided on parts 9A of the wheels 9.

Each shuttle 18 is loaded periodically with a bobbin B of weft yarn Ft designed to form a plurality of successive wefts. The weft yarn is therefore loaded onto the shuttles at relatively long intervals depending on the length of yarn which can be stored on the bobbins and which, in turn, is dependent on the yarn thickness. During the intervals between loading of the shuttles, the individual spools are loaded with yarn. The spools are preferably formed by loaders disposed above the shuttles and following the shuttles in their repeated runs. After the formation of the bobbins, one for each shuttle, and after the emptying of the bobbins contained in the shuttles which deposit the weft, all the bobbins are transferred into the shuttles, by being moved to a position in which they can be loaded into the shuttles by transfer cams or other transfer members of mechanical or electrical type. In addition to the selection drums 29 for the jacks 24, the assembly of carriages 30 forming the continuous chain also comprises, for each shuttle, a winding and loading mechanism and a storage spool of weft yarn, the mechanisms and storage spools carrying out successive runs corresponding to the runs of the shuttles.

In particular, each carriage 30 is provided with a bracket 40 on which is disposed a spool 42 for the weft yarn Ft. On each carriage 30 there is also provided an arm 44 which extends downwards to carry a loading mechanism combined with a shaped member 46. In this member there is provided a vertical slide seat lying substantially over the respective shuttle 18, and a shaft 48 can slide in this seat. The axial movements of this shaft are controlled by an extension 48A with which a shoe 50 is rigid, guided slidably by the member 46 and carrying a roller follower 52 for cams which can be inserted and withdrawn, and for fixed cams to be described. The shaft 48 can be moved into one of two positions defined by a resilient ball peg 53 which cooperates with two annular grooves 54, 55 spaced apart on the shaft to define the two positions thereof. The lower part of the shaft 48 is slidably held in a tubular sleeve 56, which can attain two positions determined by a resilient peg 58 cooperating with a selected one of two annular grooves 60, 62 on the outside of the sleeve 56. This sleeve is slidable longitudinally and is angularly constrained to the shaft 48 by means of a diametral pin 64 which extends through two longitudinal slots 66 in the sleeve 56, the pin being engaged in the shaft 48 and in a disc 68 externally of the sleeve, and which is thus rigid with the shaft. The sleeve 56 terminates at its lower end in a disc flange 70 similar to the disc 68 and cooperating therewith in the manner indicated hereinafter to engage the weft yarn in the manner of a grip.

The shaft 48 can be rotated intermittently by a clutch when controlled by a cam to be described, which acts on a roller follower 72 designed to operate a shaft drive clutch for the purpose of winding the weft yarn Ft to form a bobbin of yarn for the shuttle. The roller follower 72 is carried by a lever 74 pivoted at 76 to the shaped member 44, 46 and carrying at its inner end a fork 78 engaging in a groove in a sleeve 80 which slides on the upper end of the shaft 48 and being rotatably engaged therewith. The sleeve 80 comprises a diametral peg 82 arranged to engage in one or another of the front teeth 84 of a toothed wheel 86 mounted idly on the sleeve 80, centered axially on the member 46 and engaging with a rack 88A formed on a front plate 88 carried by the structure 1. In this manner, as the chain-connected carriages 30 advance, and consequently the member 46 advances, the wheel 86 rotates and can rotate the shaft 48 when the sleeve 80 has been moved axially upwards by the follower 72 so as to engage the peg 82 in the teeth 84.

The front plate 88 is shaped lowerly as a cam 88B to control, against the action of an opposing spring, a roller follower 90 carried by a slide 92 which extends lowerly to constitute a yarn guide 92A arranged to cyclically displace the weft yarn Ft originating from the respective spool 42, so as to cause it to make regular helical turns on the lower end of the shaft 48 to form a bobbin B to be transferred onto the respective shuttle 18.

Figures 16, 17:
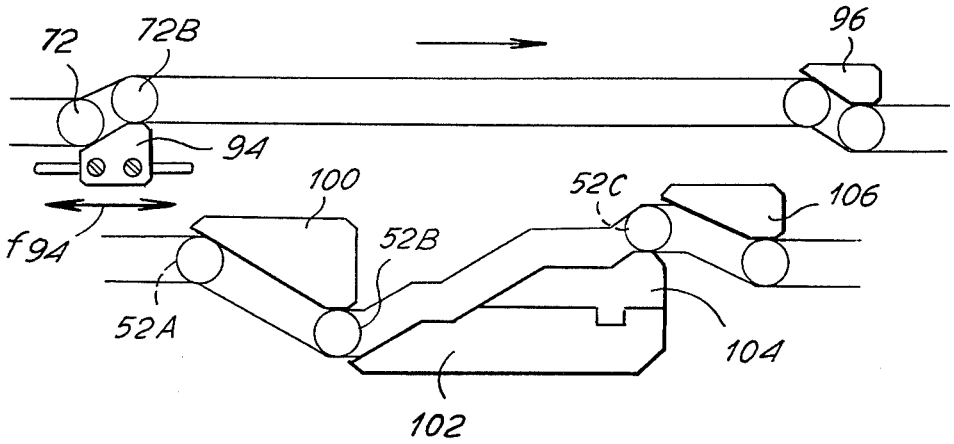
FIGS. 16 and 17 are diagrammatic views of cams and trajectories of control members for winding the yarn in forming a bobbin, and for transferring a bobbin into the corresponding shuttle respectively.

To control the engagement and disengagement for the shaft 48, the follower 72 can be operated by a pair of cams 94 and 96 located along one of the two semi-circular paths of the shuttles. The cam 94 raises the follower 72 from position 72A to position 72B (see FIG. 16) when the cam 94 is inserted, i.e. when it is made to move towards the structure 1 in the manner indicated hereinafter. The cam 96, which is advantageously also movable, relowers the raised follower 72 to position 72A, after a run of the corresponding carriage 30 over the path length between the cam 94 and cam 96. The position of one or both of the cams 94 and 96 can be adjusted horizontally along the working front in accordance with the double arrow f94, so as to vary the distance between the two cams 94 and 96 and thus vary the number of revolutions made by the shaft 48 during each cylical run as required, in addition to being able to vary the number of runs in which the cams 94 and 96 are inserted. These adjustments thus allow adjustment of the length of weft yarn Ft with which the bobbin B is formed.

Figure 4:
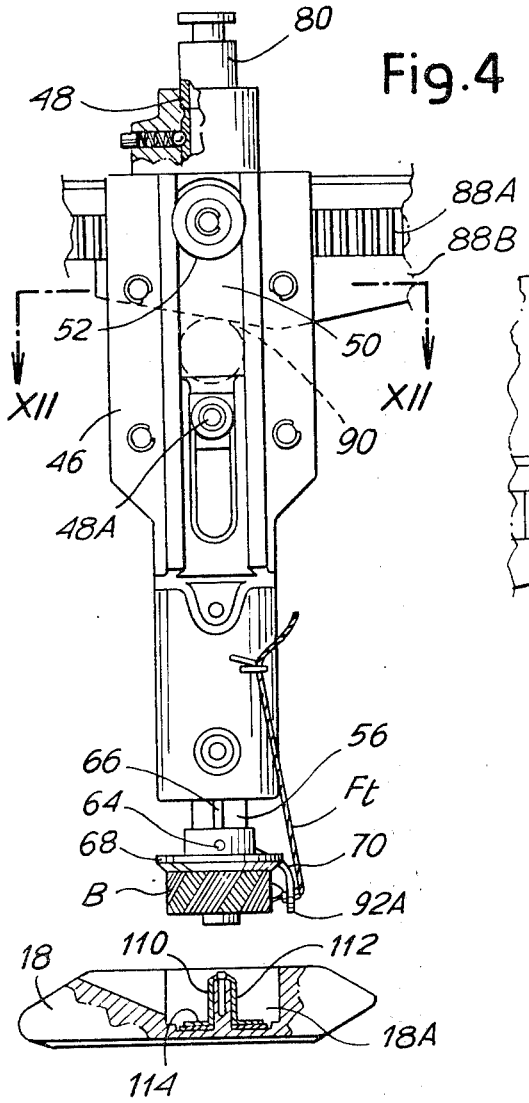
FIG. 4 is a front view of a winding-loading mechanism in the position in which it forms a bobbin.

The bobbin B is wound by the continuous reciprocating movement of the yarn guide 92A, which distributes the weft yarn over the lower end of the shaft 48 when this is in the position shown in FIG. 4, in which the shaft 48 lowerly projects from the disc 70, and the disc 68 is close to the disc 70 as the peg 53 is engaged in the groove 55 and the peg 58 of the sleeve 56 is engaged in the groove 60. Under such conditions, the end of the weft yarn is engaged between the two discs, and on rotating the assembly 48, 70, 68, the bobbin B is wound for the time determined by the time for the run between the cam 94 and cam 96 by the follower 72 multiplied by the number of times this run is repeated. The bobbin B is thus formed, and after its formation it remains on the end of the shaft 48 which is no longer rotating, and is ready to be moved into the position shown in FIG. 4.

Figure 5:
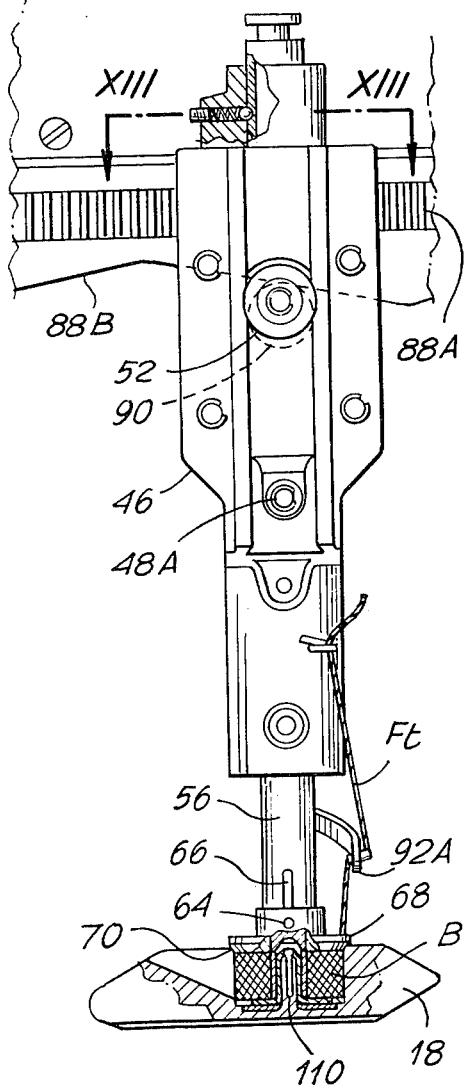
FIGS. 5, and 6 are views similar to FIG. 4 showing two stages in the transfer, i.e. loading, of a bobbin into the corresponding shuttle.
Figure 6:
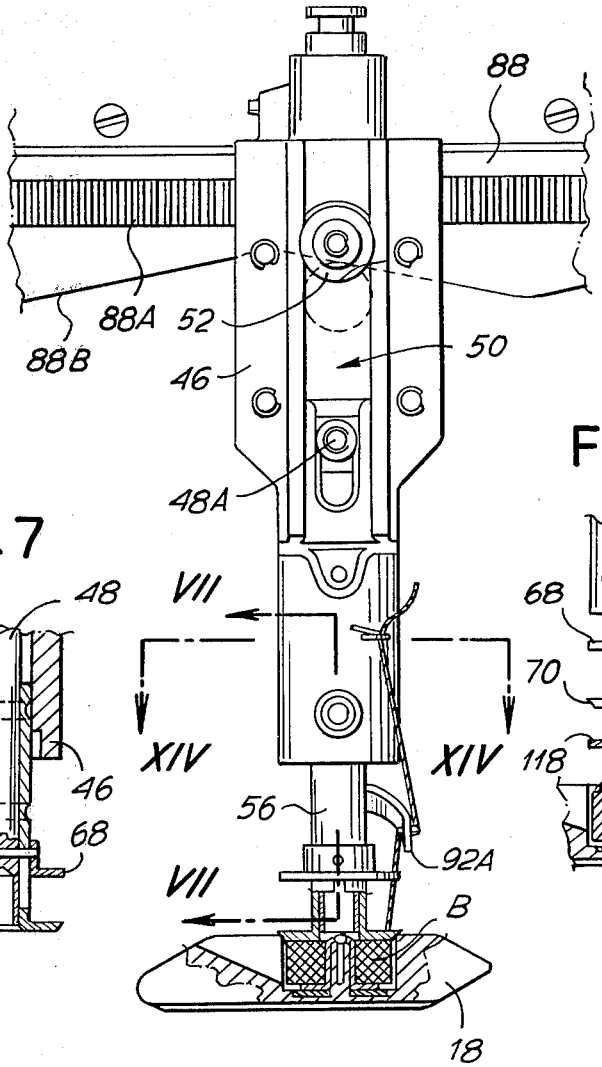
Figure 7:
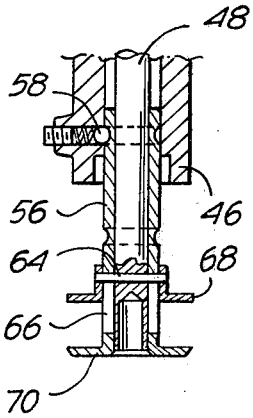
FIG. 7 is a section on line VII—VII of FIG. 6.

A description will now be given of the stages in transferring a bobbin B from the position in which it is formed and set ready for loading, until it is in its respective shuttle 18. The sequence is that shown by the successive positions illustrated in FIGS. 4 to 11, these positions being obtained by axial movements of the shaft 48 by means of the roller follower 52. This follower can cooperate with a lowering cam 100, which can be inserted and withdrawn, and can also cooperate with a raising cam in two parts 102 and 104 (the part 104 being insertable and withdrawable, and with a fixed lowering cam 106. These cams are disposed along the semi-circular path of the shuttles 18 and carriages 30. When the cams 100 and 104 are inserted, in the manner indicated hereinafter, the cause transfer of the prepared bobbin from the loader to the underlying shuttle (where the previous bobbin has been emptied), the follower 52 arrives in the position 52A of FIG. 17, and is lowered by the cam 100 to position 52B. By this means, the shaft 48 moves downwards so that the pin 64 drags the sleeve 56 and the two discs 68 and 70 coupled thereto, until it reaches (FIG. 5) the compartment 18A provided in the shuttle 18 to receive the bobbin B.

In the compartment 18A, there is provided a column 110 on which the hub 112 of a disc 114 is mounted and centered, so that it is idle on the column 110 and consequently on the shuttle. The disc 114 and its tubular hub 112 are designed to receive the bobbin B. The lower end of the shaft 48 is hollow so that when lowered by the cam 110, the shaft 48 can surround the hub 112 and reach the disc 114 (see FIG. 5). This maximum lowering position (position 52B of follower 52 in FIG. 17) attained by the cam 100 is followed by a first partial raising of the shaft 48 by the cam 102, as far as the position shown in FIGS. 6 and 7, in which the disc 70 has remained in its lowered position with the peg 58 in the groove 62, whereas the shaft has retracted to the interior of the disc 70 by withdrawing from the hub 112 and leaving thereon the bobbin retained by the disc 70. As the shaft 48 withdraws, it drags with it the disc 68 so that the end of the yarn, which was previously engaged between the two discs 68 and 70, is released. A further raised position (FIGS. 8 and 9) of the assembly 48, 56 is then attained by the action of the first portion of the inserted cam 104. The yarn extending between the bobbin B in the shuttle 18 and the yarn guide 92A is then cut (see FIG. 8) along a successive flat portion of the cam 104.

The reference numeral 118 indicates a cutting mechanism of conventional type, which is in a position such as to be able to act on the yarn in the path of follower 52 along the flat portion of the cam 104. The cutting operation and the loading of the shuttle take place, as stated, along one of the two semi-circular paths of the shuttles between one rectilinear front and the other. Adjacent to the cutting zone there is provided a pneumatic suction nozzle 120 (FIG. 9) which sucks up the end of the cut yarn remaining loose from the yarn guide 92A, so as to position this end into the space between the two discs 68 and 70, which have been spaced apart on raising the shaft 48 by virtue of the slack allowed by the slots 66. The follower 52 rises again from its position corresponding to the intermediate flat portion of the cam 104, to raise the shaft to the maximum raising position of the disc 70 by a distance which can be seen by comparing FIGS. 9 and 10, to drag with it the sleeve 56 and consequently the disc 70 into the position defined by the resilient peg 58 in cooperation with the groove 60. At this point, follower 52 has reached the position 52C (FIG. 17), and the loader mechanism has assumed the position of FIG. 10. At this point, the cam 106 lowers the shaft 48 and and disc 68, which is urged against the disc 70 (see FIG. 11) to engage the end of the yarn which has positioned between the two discs by the nozzle 120 as the loading device passed in front of it. This lowering by the cam 106 also causes the lower end of the shaft 48 to project below the coupled discs 68, 70 into the position shown in FIG. 4, so as to be able to again wind a bobbin in the described manner, with the aid of the cam 94 when this is inserted.

As already stated, it will be noted that the transfer of a bobbin from the loading mechanism to a shuttle can take place over any path portion other than the working front or either working front, whereas winding takes place over a part of the path enclosed by the shuttles and by the loading mechanisms, and consequently by each follower 70, and defined by the cams 94 and 96. In each case, the time available for winding each bobbin onto the respective shaft is nearly equal to the time necessary for depositing successive wefts by any one shuttle.

Figure 1:
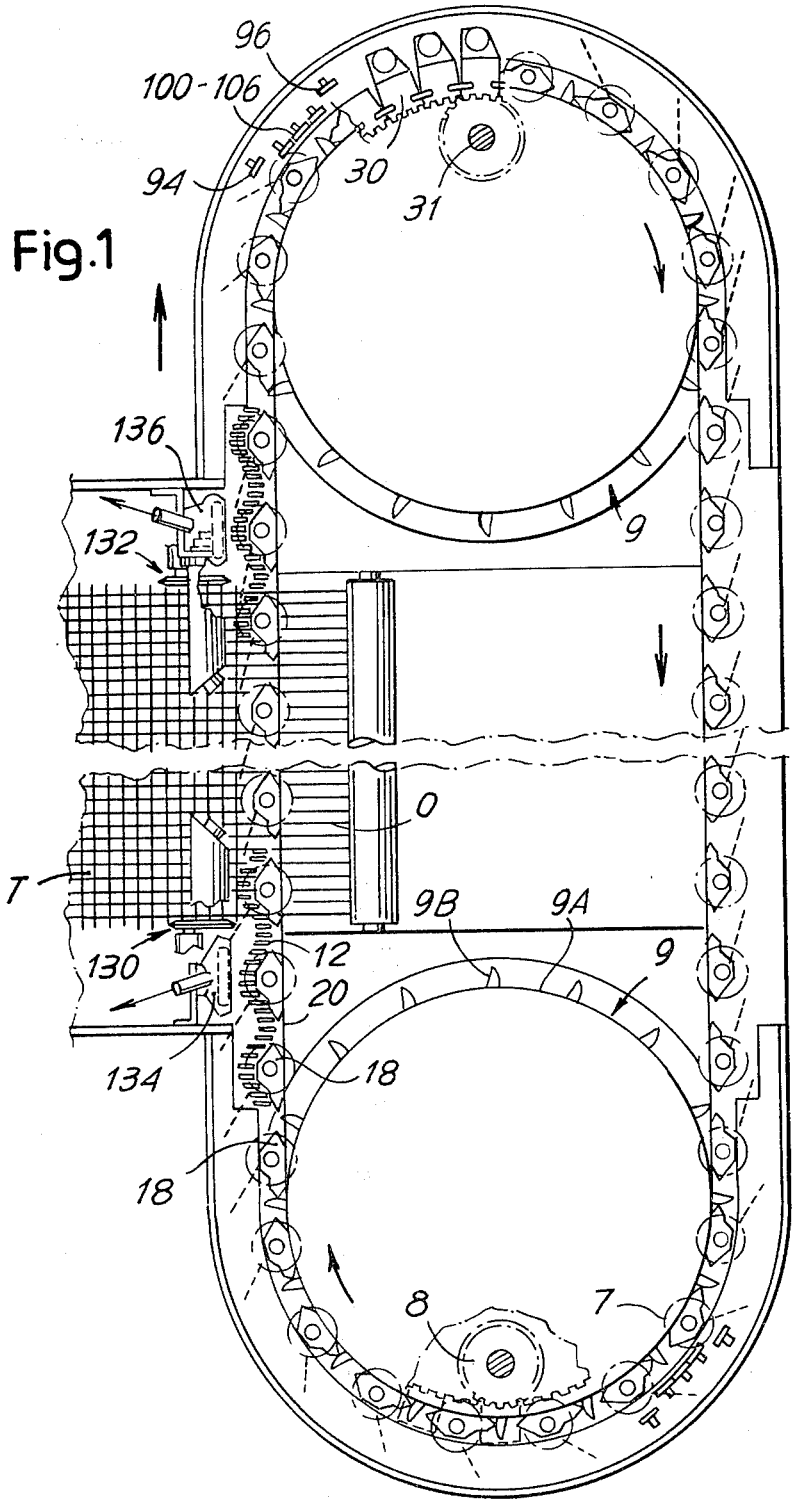
FIG. 1 is a schematic plan view of a loom in accordance with the invention.
Figure 8:
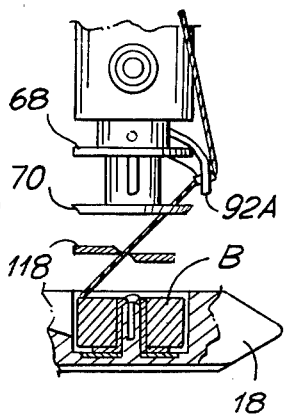
Figure 12:
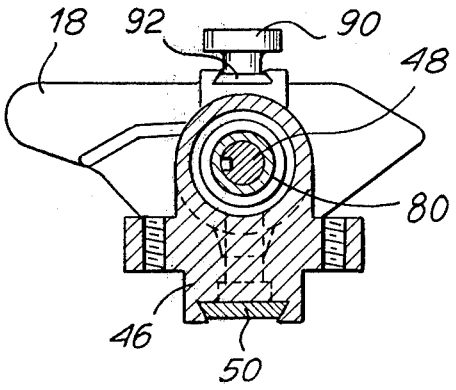
FIGS. 12 to 15 are cross-sections on lines XII—XII of FIG. 4, XIII—XIII of FIG. 5, XIV—XIV of FIG. 6, and XV—XV of FIG. 9.
Figure 13:
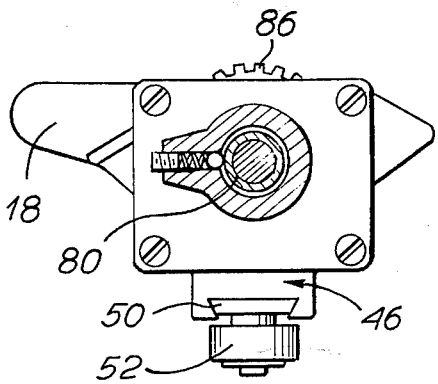
Figure 14:
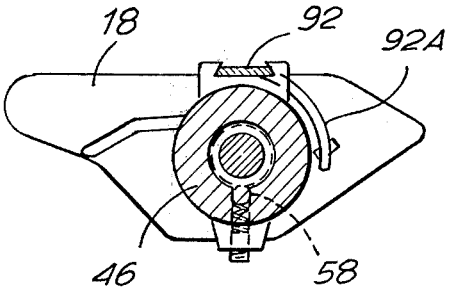
Figure 15:
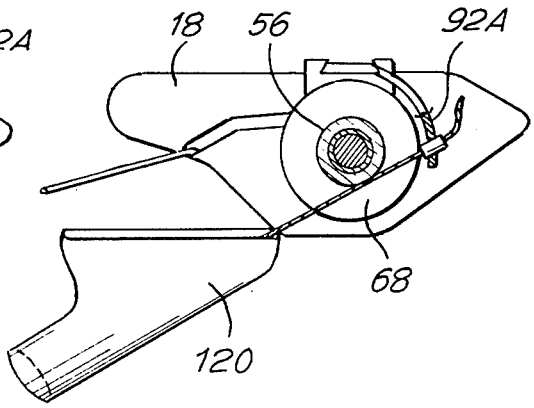

The cutting mechanism indicated by 118 in FIG. 8 can be of any type suitable for electrical or mechanical continuous or intermittent operation, and is suitably controlled. The cutting mechanism 130 (FIG. 1) is disposed to the side of the fabric T on that side from which the shuttles enter the warps, to cut the wefts along the edge of the fabric. The cutting mechanism 130 is disposed in a withdrawn position so as to cut the weft yarns along one of the edges of the fabric after forming the fabric. The reference numeral 132 indicates a further cutting mechanism disposed to the side of the fabric T but on the opposite side, i.e. on the side on which the shuttles emerge from the working front between the warps. The two cutting mechanisms 130, 132 are combined with suction nozzles 134 and 136. The nozzle 134 is arranged to stretch the yarn to initiate the tying of the weft, and after cutting it disposes of the weft pieces from the wefts inserted to the various shuttles. The nozzle 136 can also cooperate in positioning the yarn relative to the cutting mechanism 132, and in disposing of the pieces once only, i.e. when the last weft has been used. The cutting mechanism 132 cuts each time the weft is deposited. It must be moved into the withdrawn position during transit of the shuttles which carry the last weft in order to delay the cut, so as to allow the shuttles to empty the yarn, which is then cut and sucked in by the nozzle 136. This frees the shuttles from any yarn residue so that they become completely empty for the next loading.

Figure 18:
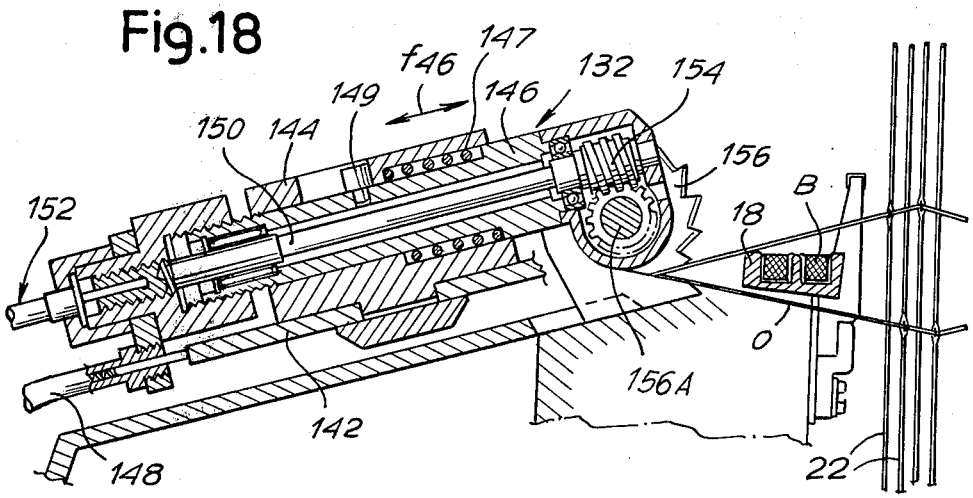
FIGS. 18 to 20 show a cutting mechanism, and in particular a mechanism for cutting along the outlet edge of the fabric.
Figure 19:
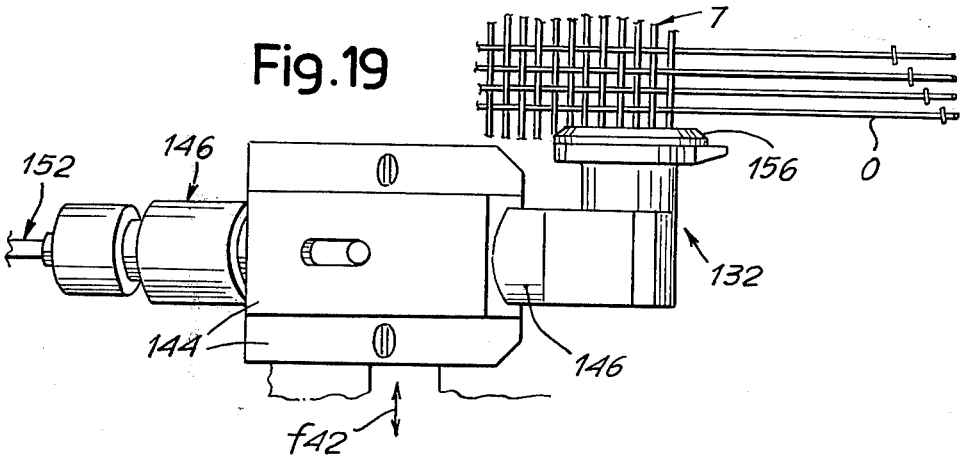
Figure 20:
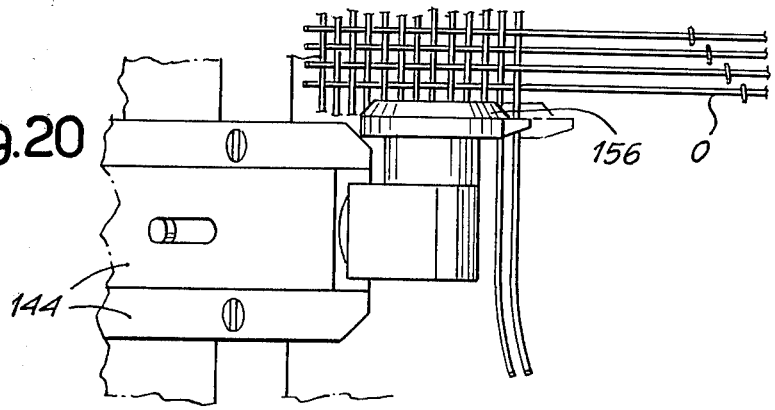

FIGS. 18 to 20 show a section through one example of a cutting mechanism 132, together with a plan view of the same cutting mechanism in two working positions during distribution of wefts and during depositing of the final wefts from the shuttle bobbins.

The mechanism 132 is carried by a support 142, which comprises a slot along which a member 144 can be adjusted in the direction of the double arrow f42 to vary its distance from the edge of the fabric T. The member 144 forms a sliding seat for the actual cutting mechanism, which comprises a sleeve 146 slidable along the double arrow f46. The sleeve 146 is made to slide, against the action of a return spring 147, by a cable 148 which reacts on the support 142. A peg 149 limits the axial movements of the sleeve. The sleeve 146 holds a spindle 150 which is operated by a flexible shaft 152, and which, via a reduction gear 154, drives the shaft 156A of a toothed disc blade 156, the continuous rotation of which cuts the weft Ft. The mechanism is advanced during normal feed (FIG. 19) and cuts the weft which has just been deposited. When the last weft is deposited from the bobbins of all the shuttles, the cutting mechanism is temporatily withdrawn (FIG. 20) so that the cutting action becomes delayed until the point at which all the residual weft has been unwound from the shuttles, before said weft is cut.

It has previously been stated that the cams 94, 100, 104 and 96 must be controlled in accordance with a programme which governs the cycle comprising the formation of the bobbins, the loading of the bobbins on to the shuttles, and the taking out of operation of the cutting mechanism 132 when the yarn is emptied from the previously bobbins in the shuttles which are to receive the newly formed bobbins.

For this purpose, a mechanical chain programmer 170 (see FIG. 2) is provided, which can advance through one step for each complete revolution of the shuttles. The number of step advancements of this chain must therefore be equal to the number of wefts obtainable from each bobbin, because the programme must extend from one replacement cycle to the other, in order to determine both the replacements during the last revolution of the cycle, and, previously, the formation of the bobbins in the loading mechanisms. The projections or rollers 172, 174, 176 act on three tappets associated with the cams 94, 96, 100, 104 and 106, of which only the tappet 178 for controlling the cam 94 is shown in detail. This control is obtained via a flexible shaft 180 (for example comprising a line of small balls for thrust transmission purposes) and spacers, for acting against the action of an opposing spring on a slide 181 guided on a support 182 combined with a framework 184 rigid with the structure 1 and also carrying the mechanisms of usual type for supporting and moving the programmer chain 170. The cam 94 is mounted on the slide 181 such that it can be adjusted in the direction of the double arrow f94. The tappets for the other cams 100 and 104 are similar to that described, except for the transverse adjustment. The fixed cams 102, 106 are supported directly by the framework 184. A fourth tappet acts on the flexible shaft 182 to control the movement of the cutting mechanism 132 in the said manner. The cutting mechanism 132 can be displaced so as to delay the cutting action for the entire unwinding during the last revolution of the shuttles, until they are completely empty and before reloading them. The yarn residues from the bobbins are removed by the nozzle 136. The cutting device 132 can be controlled by the programmer 170 so that it briefly returns to its cutting state once during the last revolution of the shuttles, such as to each time cut the end which comes in front of it without any weft yarn residues remaining wound in the shuttles during this brief operation of the cutting device 132.

In the loom particularly described, since a winding-loading device is provided for each shuttle, the bobbins can be wound at lower speeds than can occur with the previously proposed arrangement having only a limited number of winding-loading device in relation to the number of shuttles.

What is claimed is:

1. In a travelling wave shedding loom, a plurality of shuttles, and a device for winding and loading shuttle bobbins of the loom, said device comprising a movable support member associated with each shuttle and movable with the shuttle, chain carriages with selection means and wrap control cams, said carriages advancing with the shuttles, said movable support members being supported by the carriages a winding-loading mechanism and means for mounting a storage spool carried by each support member, means for withdrawing metered quantities of weft yarn from each storage spool and for forming one respective bobbin per shuttle on the respective winding-loading mechanism during delivery of successive wefts from a preceding bobbin, and means for effecting transfer of the bobbin from the mechanism to the respective shuttle.

2. A loom as claimed in claim 1, wherein each winding-loading mechanism comprises a winding shaft, a drive-transmitting clutch for driving the shaft to wind yarn thereon to form a bobbin, means for displacing the shaft axially to transfer the bobbin into the associated shuttle, and means for discharging the bobbin from the winding shaft, said loom further comprising yarn cutting means operative to act successively on the yarns of the bobbins formed on the successive mechanisms.

3. A loom as claimed in claim 2, further comprising insertable cams for controlling the drive-transmitting clutches to permit winding of a precise quantity of yarn for each bobbin, at least one of the said clutch-controlling cams also being adjustable longitudinally to adjust the quantity of yarn contained in the bobbins, and thereby the number of wefts which can be deposited by each bobbin.

4. A loom as claimed in claim 2, wherein the clutches are rotated by the movement of the movable support member.

5. A loom as claimed in claim 2, wherein each said winding shaft has a disc-shaped end portion for forming said discharge means, and each mechanism further comprises disc means cooperating with said disc-shaped end portion and being movable relative thereto to grip the end of the yarn, to cut it, and to release it.

6. A loom as claimed in claim 5, wherein the means for displacing each shaft axially comprises insertable cams for lowering the shafts to transfer the bobbin and for raising the shaft in two stages whereby the associated yarn is gripped and cut between the cooperating disc-shaped end portion and disc.

7. A loom as claimed in claim 1, comprising a cutting mechanism along the edges of the fabric to cut the wefts as they are deposited, said cutting mechanism being displaceable to delay its action on the wefts and obtain unwinding of the weft residues as the yarn bobbins located in the shuttles become emptied.

8. In a travelling wave shedding loom, a plurality of shuttles, and a device for winding and loading shuttle bobbins of the loom, said device comprising a movable support member associated with each shuttle and movable with the shuttle, a winding-loading mechanism and means for mounting a storage spool carried by each support member, means for withdrawing metered quantities of weft yarn from each storage spool and for forming one respective bobbin per shuttle on the respective winding-loading mechanism during delivery of successive wefts from a preceding bobbin, means for effecting transfer of the bobbin from the mechanism to the respective shuttle, and a cutting mechanism along the edges of the fabric to cut the wefts as they are deposited, said cutting mechanism being displaceable to delay its action on the wefts and obtain unwinding of the weft residues as the yarn bobbins located in the shuttles become emptied.

* * * * *